US005732852A

United States Patent [19]

Baker et al.

[11] Patent Number: 5,732,852

[45] Date of Patent: Mar. 31, 1998

[54] VENDING MACHINE

[76] Inventors: David W. Baker, 12919 Mugleston La., Wilton, Calif. 95693; Joseph K. Caradine, 6015 Princeton Reach Way, Granite Bay, Calif. 95746

[21] Appl. No.: 518,526

[22] Filed: Aug. 23, 1995

[51] Int. Cl.[6] ..... G07F 11/24

[52] U.S. Cl. ..... 221/116; 221/114; 221/112; 221/82; 221/86

[58] Field of Search ..... 221/82, 86, 112, 221/116, 114

[56] References Cited

U.S. PATENT DOCUMENTS

| | | | |
|---|---|---|---|
| D. 90,652 | 9/1933 | Gilmer . | |
| D. 95,207 | 4/1935 | Hoban . | |
| D. 112,942 | 1/1939 | Garner et al. . | |
| D. 180,619 | 7/1957 | Probasco | D52/3 |
| 493,617 | 3/1893 | Crites | 221/82 |
| 1,387,681 | 8/1921 | Bertram . | |
| 1,842,243 | 1/1932 | Boyer . | |
| 2,010,877 | 8/1935 | Morell | 232/1 |
| 2,208,298 | 7/1940 | Mahaffey | 221/86 |
| 2,259,710 | 10/1941 | Stern | 221/107 |
| 2,465,146 | 3/1949 | Broussard | 232/16 |
| 2,483,805 | 10/1949 | Broussard et al. | 232/1 |
| 2,537,317 | 1/1951 | Probasco | 312/89 |
| 2,633,272 | 3/1953 | Moore et al. | 222/238 |
| 2,828,909 | 4/1958 | Sollenberger et al. | 232/15 |
| 2,990,975 | 7/1961 | Sereno | 221/203 |
| 3,104,028 | 9/1963 | Brown | 221/86 |
| 3,114,473 | 12/1963 | Weber | 221/82 |
| 3,163,327 | 12/1964 | Maxwell | 221/114 |
| 3,171,591 | 3/1965 | Long et al. | 232/1 |
| 3,807,628 | 4/1974 | Bock | 232/16 |
| 4,037,700 | 7/1977 | Heraty | 194/1 B |
| 4,363,392 | 12/1982 | McDonald | 194/1 B |
| 4,574,980 | 3/1986 | Kurosawa et al. | 221/116 |
| 4,632,274 | 12/1986 | Garbe | 221/96 |
| 4,671,426 | 6/1987 | Grossi | 221/82 |
| 4,679,684 | 7/1987 | Glaser | 194/350 |
| 4,896,798 | 1/1990 | Milton | 222/307 |
| 5,082,101 | 1/1992 | Baker et al. | 194/350 |

FOREIGN PATENT DOCUMENTS

| | | | |
|---|---|---|---|
| 192714 | 9/1923 | France | 221/86 |

*Primary Examiner*—William E. Terrell
*Assistant Examiner*—Khoi H. Tran
*Attorney, Agent, or Firm*—Bernhard Kreten

[57] ABSTRACT

A vending machine (10) is comprised of a platform assembly (110) encased by a transparent envelope (150) and supported by a anti-pilfering base (80) received within a housing (20). The platform assembly (110) includes a plurality of platforms (142) disposed about a helical path (260), and upon which articles to be vended are placed. A linkage assembly (170) includes a trigger means (210) and is operatively coupled between a latching mechanism (66) located within the housing (20) and at least one platform (142) to move the platform from a substantially horizontal plane to a substantially vertical downward position to discharge the article to be vended.

7 Claims, 6 Drawing Sheets

VENDING MACHINE

FIELD OF THE INVENTION

The present invention relates generally to a vending machine and, in particular, to a coin controlled machine for vending articles individually disposed on a plurality of platforms.

BACKGROUND OF THE INVENTION

A variety of coin controlled vending machines have heretofore been employed to dispense candy, nuts, gum, and small articles such as toys. The nature of the article being vended was such that they were small, very uniform in shape and characterized by smooth, non-sticking outer surfaces or packaging. Prior vending machines have had a sufficient success in vending these types of articles in a substantially free flowing manner. However, a principal defect in such vending machines is that they become jammed in attempting to vend articles which are for example, irregular in shape, or size, or include an exterior surface or wrapping which is not substantially smooth.

One attempt to solve this problem has been to use a machine which operates on the principle of pushing one article out from under the bottom of a stack of articles and through an aperture. This type of machine requires, inter alia, that each article be exactly the same thickness and that the wrapping surrounding the candy, such as a mint, does not interfere with the pushing implement. Any variation thereof causes the machine to either push only part of one article or one article plus part of another through the opening thereby resulting in a jam or deformation of the article by the machine.

In addition, pilfering of the articles to be vended remains as a prevalent problem with vending machines in use today.

The following prior art reflects the state of the art of which applicant is aware and is included herewith to discharge applicant's acknowledged duty to disclose relevant prior art. It is stipulated, however, that none of these references teach singly nor render obvious when considered in any conceivable combination the nexus of the instant invention as disclosed in greater detail hereinafter and as particularly claimed.

| PATENT NO. | ISSUE DATE | INVENTOR |
|---|---|---|
| 1,387,681 | August 16, 1921 | Bertram |
| 1,842,243 | January 19, 1932 | Boyer |
| D. 90,652 | September 12, 1933 | Gilmer |
| D. 95,207 | April 16, 1935 | Hoban |
| 2,010,877 | August 13, 1935 | Morell |
| D. 112,942 | January 17, 1939 | Garner et al. |
| 2,259,710 | October 21, 1990 | Stern |
| 2,465,146 | March 22, 1949 | Broussard |
| 2,483,805 | October 4, 1949 | Broussard et al. |
| 2,537,317 | January 9, 1990 | Probasco |
| 2,633,272 | March 31, 1953 | Moore et al. |
| D. 180,619 | July 9, 1957 | Probasco |
| 2,828,909 | April 1, 1958 | Sollenberger et al. |
| 2,990,975 | July 4, 1961 | Sereno |
| 3,171,591 | March 2, 1965 | Long et al. |
| 3,807,628 | April 30, 1974 | Bock |
| 4,037,700 | July 26, 1977 | Heraty |
| 4,363,392 | December 14, 1982 | McDonald |
| 4,679,684 | July 14, 1987 | Glaser |
| 4,896,798 | January 30, 1990 | Milton |
| 5,082,101 | January 21, 1992 | Baker et al. |

SUMMARY OF THE INVENTION

The present invention is distinguished over the known prior art in a multiplicity of ways. For one thing, the invention has a jam free capability to vend articles which are irregular in shape or size or where the article includes an exterior surface or wrapping which is not substantially smooth. In addition, the present invention provides a plurality of platforms to individually support the articles to be vended. Furthermore, the present invention provide an anti-pilfering base which includes a labyrinth of baffles which deter one from pilfering the items to be vended. The anti-pilfering baffles also serve as delivery chutes for the articles.

The vending machine of the present invention includes a platform assembly encased by a transparent envelope and supported by an anti-pilfering base received within a housing. The platform assembly includes a plurality of platforms serially disposed about a helical path and upon which articles to be vended are placed. A linkage assembly, including a trigger mechanism, is operatively coupled between the latching mechanism and the platform assembly. The trigger mechanism, upon each actuation of the latching mechanism, advances a distance along the helical path and triggers at least one platform to move from a first substantially horizontal plane to a second substantially vertical downward plane such that the article is deliver to a dispensing hole opening.

OBJECTS OF THE INVENTION

A primary object of the present invention is to provide a new novel device for dispensing articles from a vending machine.

A further object of the present invention is to provide a device as characterized above which provides an attractive display, is durable in construction, reliable in use and overcomes known prior art deficiencies.

Another further object of the present invention is to provide a device as characterized above wherein a plurality of platforms are supported in an upwardly extending helical path.

Another further object of the present invention is to provide a device as characterized above wherein each article to be vended sits individually and horizontally on a platform which is mechanically suspended on a rod.

Another further object of the present invention is to provide a device as characterized above wherein a trigger mechanism includes a cam which transverses the helical path for triggering sequentially disposed platforms in order to dispense an article placed thereon in response to actuation of a latching mechanism.

Another further object of the present invention is to provide a device as characterized above which includes a labyrinth of baffles to preclude pilfering of articles to be vended.

Another further object of the present invention is to provide a device as characterized above wherein each platform is biased in a horizontal position and responds to the coaction of a pin against the apex of the lobe of the cam to release the platform to a substantially vertically downward position such that the article will have been dispensed.

Another further object of the present invention is to provide a device as characterized above wherein a lip of the cam rides atop and is supported by sequentially disposed pins in the helical path traversed by the plurality of platforms.

Viewed from a first vantage point, it is an object of the present invention to provide a vending machine, comprising, in combination: a plurality of platforms upon which articles to be vended are placed; a latch mechanism; linkage means coupled to the latch mechanism to displace articles to be vended from a stored position on the platforms to a site where a consumer has access from having manipulated the latch mechanism; the linkage means including triggering means extending between the latch mechanism and the platform to free the article being vended.

Viewed from a second vantage point, it is an object of the present invention to provide a vending machine: a platform upon which an article to be vended is adapted to be placed; the platform operatively coupled to means which allow the platform to assume one of two positions: a first position where the platform is in a substantially horizontal plane and capable of carrying the article to be vended on an upper surface thereof; and a second position where the platform is collapsed to a substantially vertically downward position such that the article will have been dispensed.

Viewed from a third vantage point, it is an object of the present invention to provide a method for vending articles from a vending machine, comprising the steps of: placing a plurality of articles on platforms located about a helical path; and advancing a trigger mechanism about the helical path to sequentially discharge the articles as the trigger mechanism moves along the helical path.

These and other objects will be made manifest when considering the following detailed specification when taken in conjunction with the appended drawing figures.

DESCRIPTION OF PREFERRED EMBODIMENTS

Figure 1:
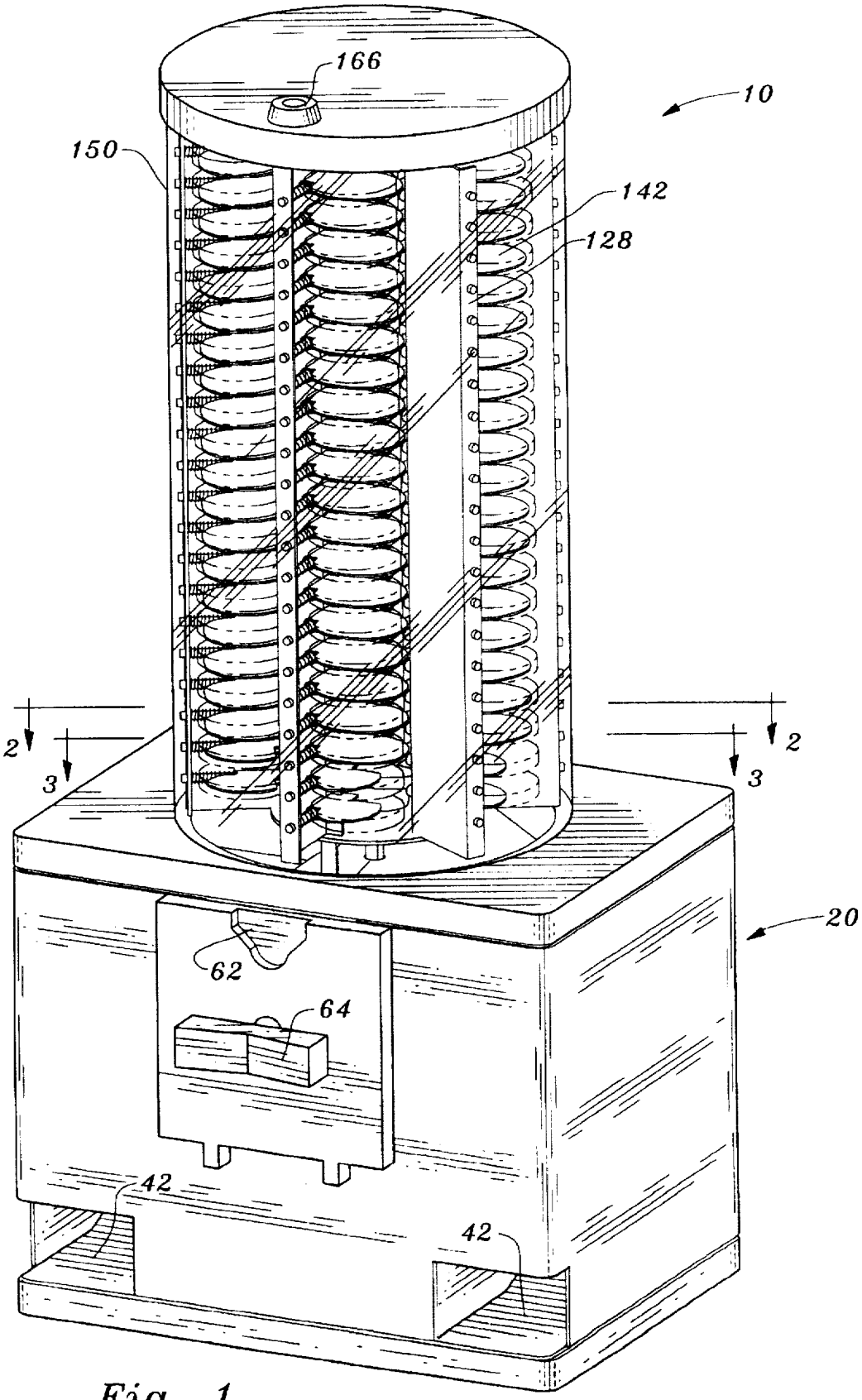
FIG. 1 is a perspective view of a vending machine according to the present invention.
Figure 2:
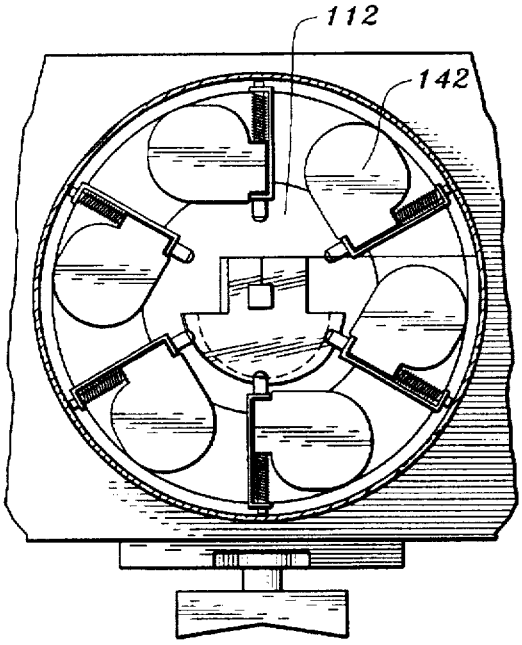
FIG. 2 is a sectional view taken along lines 2—2 of FIG. 1.
Figure 3:
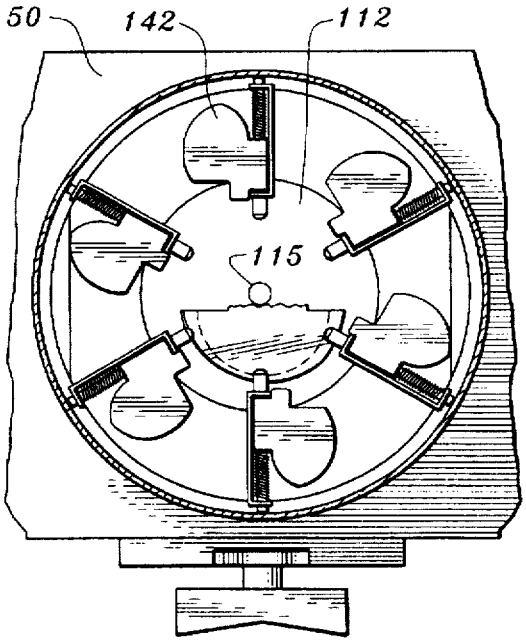
FIG. 3 is a sectional view taken along lines 3—3 of FIG. 1.

Considering the drawings, wherein like reference numerals denote like parts throughout the various drawing figures, reference numeral 10 is directed to the vending machine according to the present invention.

In essence and referring to FIGS. 1 through 6, a vending machine 10 is comprised of a platform assembly 110 encased by a transparent envelope 150 and supported by an anti-pilfering base 80 received within a housing 20. The platform assembly 110 includes a plurality of platforms 142 disposed about a helical path 260, (FIG. 17) and upon which articles to be vended are placed. A linkage assembly 170 includes a trigger means 210 and is operatively coupled between a latching mechanism 66 located within the housing 20 and at least one platform 142 to move the platform from a substantially horizontal plane to a substantially vertical downward position to discharge the article to be vended.

Referring to FIGS. 1 through 6, the housing 20 includes a top panel 50, a base panel 22 and four-sided construct 30 interposed therebetween. The four-sided construct 30 includes substantially parallel side panels 32, 34, a back panel 36 and a front panel 40. The front panel is provided with at least one dispensing hole opening 42 and a coin mechanism slot 44. The four-sided construct 30 includes an upper peripheral lip 46 and a lower peripheral lip 48 which are preferably, instepped from the panels 32, 34, 36 and 40 of the four-sided construct 30. The lower peripheral lip 48 nests within a flange 28 upwardly extending from a bottom surface 24 of the base panel 22. Similarly, the upper peripheral lip 46 nests within a flange 56 downwardly extending from a bottom surface 57 of the top panel 50. The top panel 50 and the base panel 22 may be fitted to the four-sided construct 30 by a friction interface fit or permanently by welding the corresponding parts to one another.

A coin mechanism 60 is received within the coin mechanism slot 44 and is preferably rigidly coupled to the housing 20. The coin mechanism 60 includes a coin slot 62 in which a coin or the like may be inserted in order to allow a handle 64 to freely rotate and actuate a latching mechanism 66. Preferably, the latching mechanism 66 includes a shaft 68 having a first angled portion 69 at one end coupled to an axle 65 (FIG. 5) of the handle 64 and a crank portion 70 at the opposite end of the shaft 68.

The anti-pilfering base 80 is received within the housing and includes a roof 82 with sloped sides extending from an apex to a pair of generally parallel side walls 88, 90. A lowermost portion of each side wall includes integrally formed brims 92, 94 which extend outwardly in a substantially horizontal plane. The brims 92, 94 preferably engage the top surface 26 of the base panel 22 and thus provide an area of support for the anti-pilfering base 80. A labyrinth of baffles 98, 100, 102 are preferably provided on the exterior surface of each parallel side wall 88, 90 of the anti-pilfering base 80 and preclude one from pilfering the items to be vended accordingly. The anti-pilfering baffles also serve as delivery chutes for the articles. The lowermost baffle 102 leads to dispensing hole opening 42. The baffle 102 includes a horizontal portion nearest opening 42 and leads to an up ramp. Median baffle 100 is preferably a planar construct oriented such that a projection intersects a plane designed by the up ramp. Similarly, top baffle 98 defines a plane and its projection intersects median baffle 100. Top baffle 98 and up ramp are substantially parallel. Pilfering, e.g. by a coat hanger past opening 42 is thwarted by a bottom face of top baffle 98 (arrow "B"), while articles can be vended freely along the path defined by arrow "A".

Preferably, at least one brace 111 is used to connect the platform assembly 110 to the anti-pilfering base 80 such that the platform assembly extends through and beyond an opening 52 in the top panel 50 of the housing 20.

Preferably, a transparent envelope 150 encases the platform assembly 110. The envelope 150 includes a substantially cylindrical body 152 extending from an opened bottom end 156 to a top end which is provided with a lid 162. The lid 162 includes a downwardly extending peripheral rim 164 which circumscribes a topmost portion of the substantially cylindrical body 150. A locking means 166 is disposed through the lid 162 and coacts with a catch 127 provided in the top plate 120 of the platform assembly 110. The opened bottom end 156 seats within an annular groove 54 circumscribing the opening 52 in the top panel 50 of the housing 20.

The platform assembly 110 is supported on the roof 82 of the anti-pilfering base 80 by a plurality of braces 111 and which are preferably rigidly coupled thereto. The platform assembly 110 preferably includes a plurality of U-shaped brackets 128 which are spaced apart and substantially vertically extend from a bottom plate 112 to a top plate 120. The U-shaped brackets 128 each include a vertical bight portion base 130 (FIG. 7) and substantially two parallel, vertical arms 132, 134. The arms are oriented to both extend in the same direction and are held in a spaced-apart relationship by the base 130. Each arm 132, 134 is provided with pairs of apertures which are spaced apart in successive horizontal planes which run from a lowermost end to an uppermost end of both of the arms 132, 134. Thus, each aperture in arm 132 has a one-to-one correspondence with an aperture in arm 134 defining the pair and is axially aligned therewith.

Figure 7:
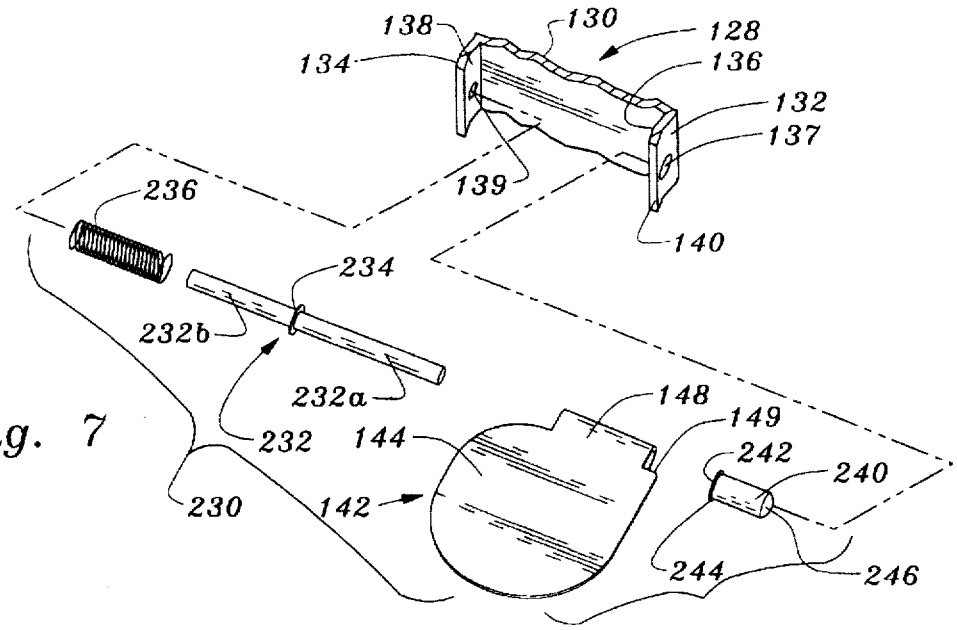
FIG. 7 is an exploded parts view of an axle assembly.

The platform assembly 110 includes a plurality of platforms 142 serially disposed about a helical path 260 (FIG. 17) and upon which articles to be vended are placed. Referring to FIG. 7, each platform 142 is pivoted about an axle assembly 230 traversing between the two axially aligned apertures 137, 139 in the arms 132, 134 of the U-shaped brackets 128. Each axle assembly 230 includes an axle rod 232, a stop 234 disposed on the axle rod 232, a spring 236 and a cap 240 having a blind bore 242. A length **232*a* of the axle rod 232 extends through a sleeve 148 of the platform 142 and into the blind bore 242 of the cap 240. The cap 240 is received within the aperture 137 of the arm 132 and includes a rimmed bottom 244 which abuts the inner surface 136 of arm 132 to preclude the cap 240 from passing therethrough. An opposite length 232*b* of the axle rod 232 is circumscribed by a spring 236. Rod 232*b* is freely received within the aperture 139 provided in the arm 134 such that the spring 236 is captured between an inner surface 138 of the arm 134 and the stop 234. When the platform 142 is raised to a substantially horizontal position, the axle assembly 230 uses the spring 234 to bias a notch 149 provided in the platform 142 against a platform contact edge 140 of the U-shaped bracket 128 to mechanically suspend the platform in the raised position. Please see FIG. 8A. Note that each adjacent cap 240 (and therefore platform 142) are located on the spiral path of FIG. 17**.

A linkage assembly 170 (FIG. 4) including a trigger mechanism 210 (FIG. 6) is operatively coupled between the latching mechanism 66 and the platform assembly 110 to free articles to be vended one at a time. The linkage assembly 170 includes a rod 174 preferably having a shaft 176 of substantially square cross-section. The rod 174 preferably extends through a central hollow of the platform assembly 110, through the anti-pilfering base 80 and into the interior of the housing 20. End 178 of the rod 174 is coupled to a threaded rod cap nut 172. The rod cap 172 is seated in a recess 124 located on the top surface 122 of the top plate 120. The rod 174 extends from the cap 172 through an aperture 125 disposed in the top plate 120 and continues to extend out through a similar aperture 115 (FIG. 3) provided in the bottom plate 112 of the platform assembly 110. The rod 174 also extends through an opening 84 provided on the roof 82 of the anti-pilfering base 80 and into the interior of the housing 20 where it terminates at a threaded end 180. The rod cap 172 precludes the rod from falling down to the base panel 22 of the housing 20.

Figure 4:
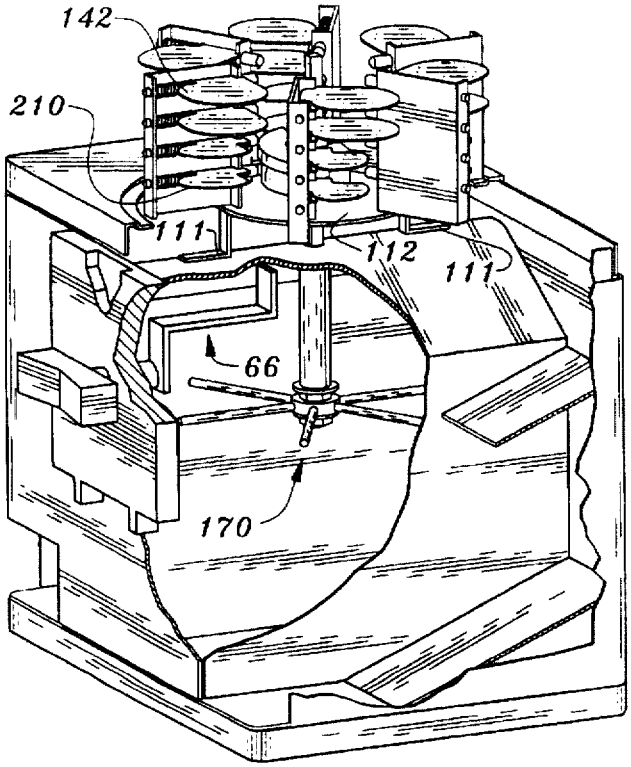
FIG. 4 is a partially fragmented perspective view of a housing and an anti-pilfering base revealing details of a latching mechanism and linkage means.
Figure 5:
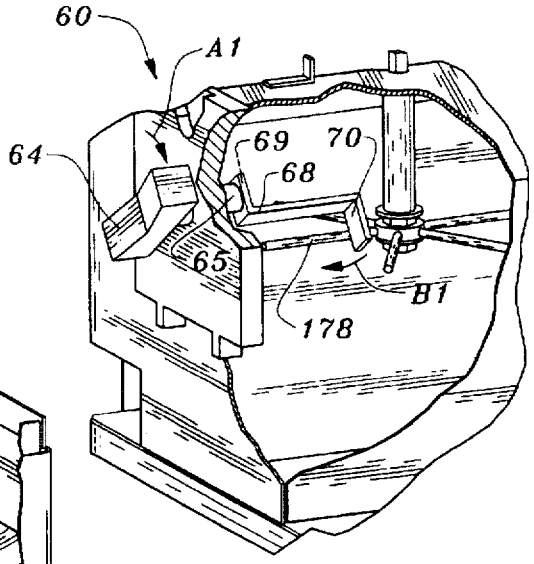
FIG. 5 is a partially fragmented perspective view of the housing and anti-pilfering base revealing the coaction between parts of the latching mechanism and linkage means.
Figure 6:
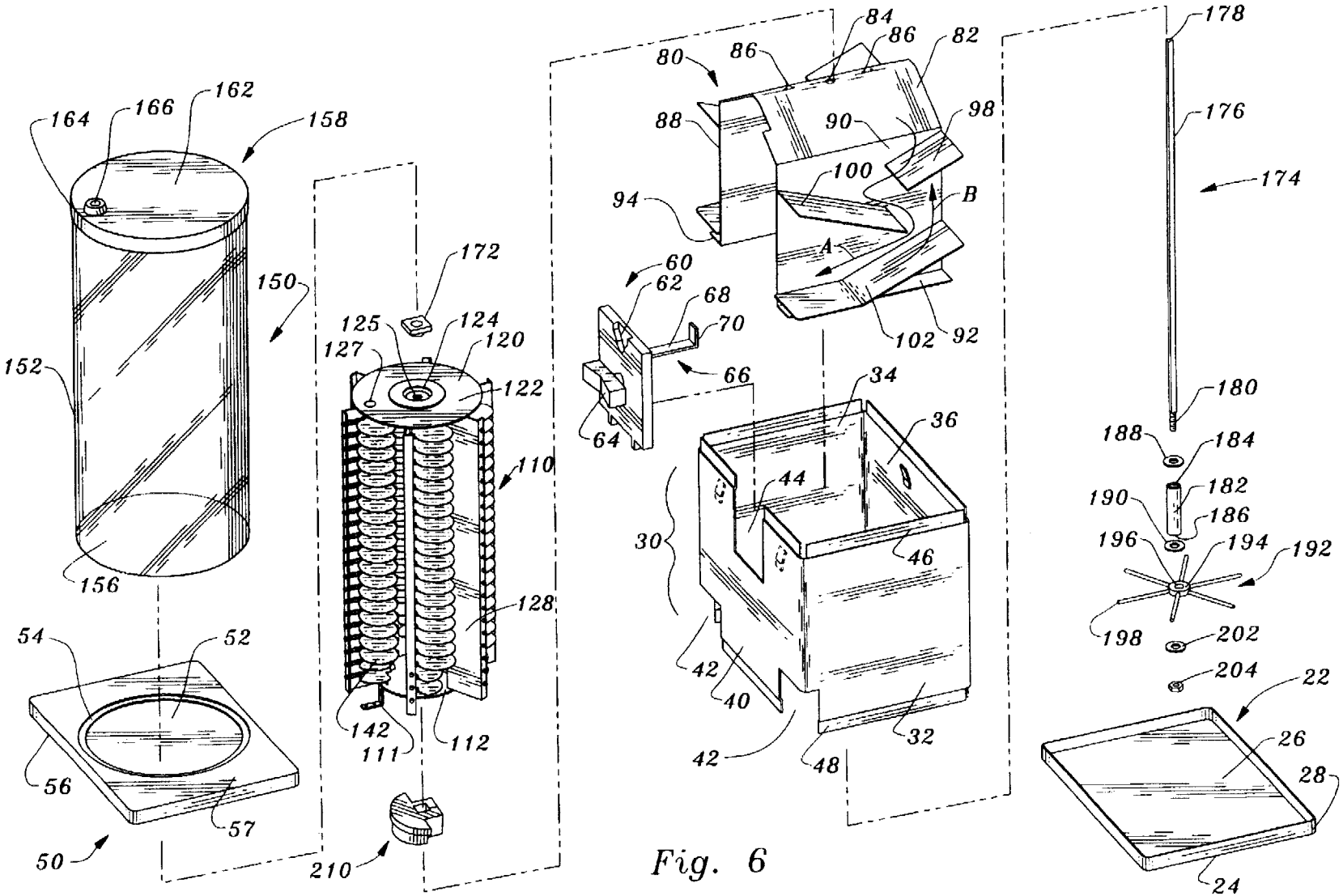
FIG. 6 is an exploded parts view of the vending machine according to the present invention.

Referring to FIGS. 4, 5 and 6, a rimless spoked wheel 192 is coupled at the threaded end 180 of the shaft 176 and is spaced from a bottom surface of the roof 82 of the anti-pilfering base 80. The spoked wheel 192 includes a hub 194 and spokes 198 radially extending from the hub 194. An aperture 196 is provided in a centermost portion of the hub 194. The aperture 196 slideably couples onto the threaded end 180 of the shaft 176 and is precluded from falling off by a lock washer 202 and a lock nut 204 threading onto the threaded end. The spacing between the spoked wheel and the bottom surface of the roof 82 is preferably provided by sequentially locating a first washer 188, a hollow spacer 182 and a second washer 190 onto the shaft 176 prior to placing the spoked wheel and lock washer onto the shaft 176 and then threadedly coupling the lock nut to the threaded end 180.

Referring to FIG. 5, when the handle 64 of coin mechanism 60 is rotated about arrow "A1" the crank 70 of the latch mechanism 66 engages at least one radially extending spoke 198 of the spoked wheel 192 and causes it to rotate about arrow "B1" and in turn causes the rod 174 to also rotate in the same direction.

Figure 8A:
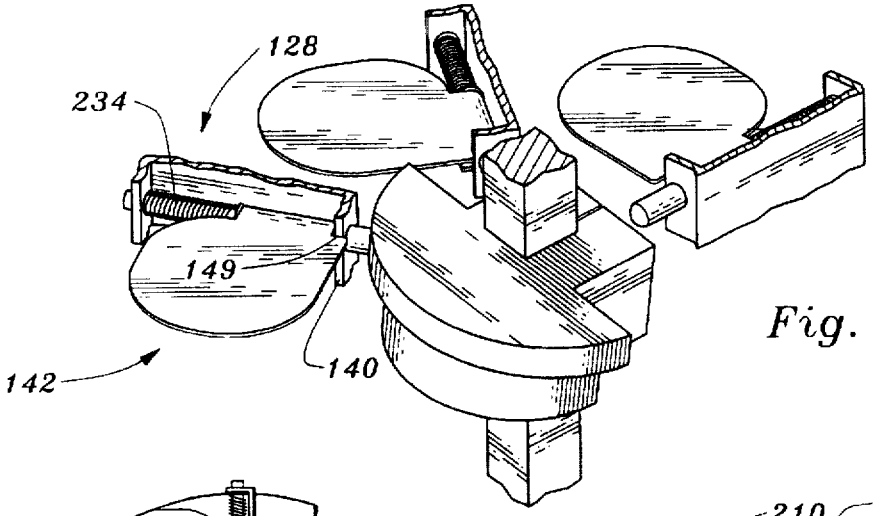
FIG. 8A is a perspective view of a cam disposed on a shaft and riding on a cap.
Figure 8B:
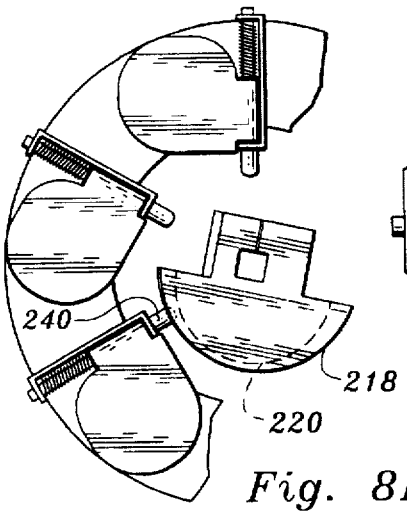
FIG. 8B is a top plan view of that which is shown in FIG. 8A.
Figure 8C:
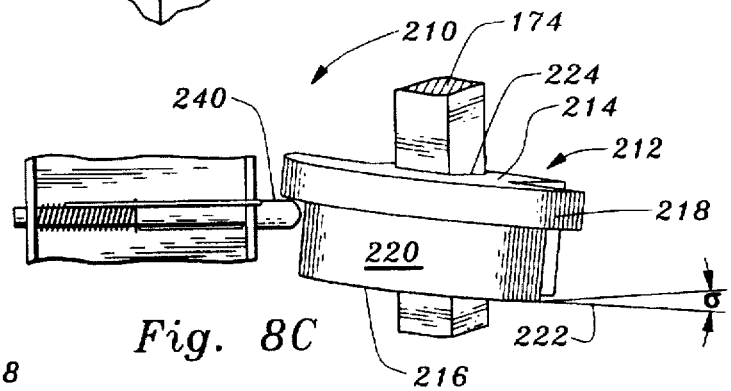
FIG. 8C is a side elevational view of that which is shown in FIG. 8A.
Figure 9A:
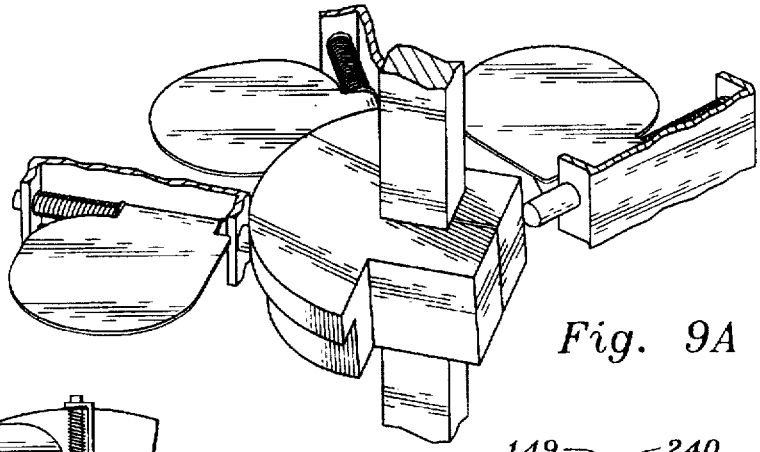
FIG. 9A is an elevational view of that which is shown in FIG. 8A with the cam rotated a distance in the clockwise direction and riding on two caps.
Figure 9B:
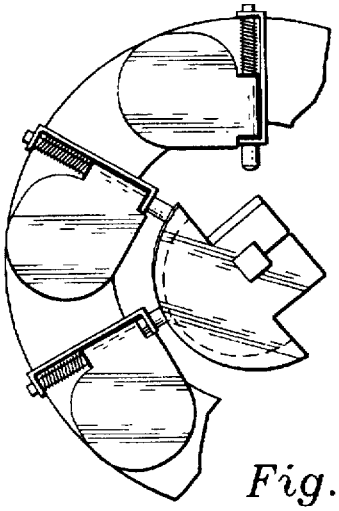
FIG. 9B is a top view of that which is shown in FIG. 9A.
Figure 9C:
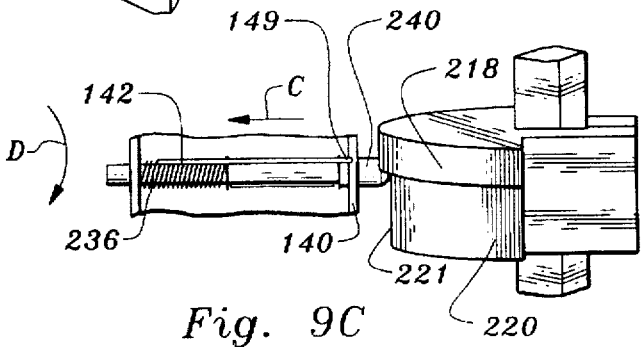
FIG. 9C is a side elevational view of that which is shown in FIG. 9A.
Figure 10A:
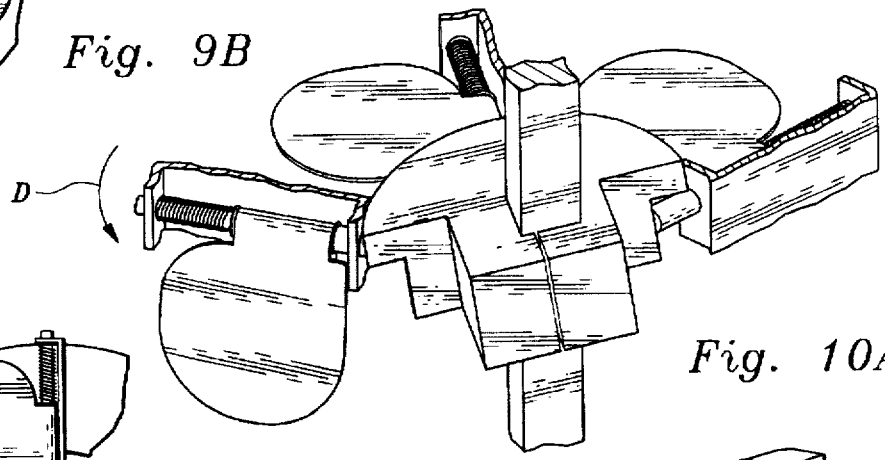
FIG. 10A is an elevational view of that which is shown in FIG. 9A with the cam riding on three caps and having triggered a platform in a substantially vertical downward position.
Figure 10B:
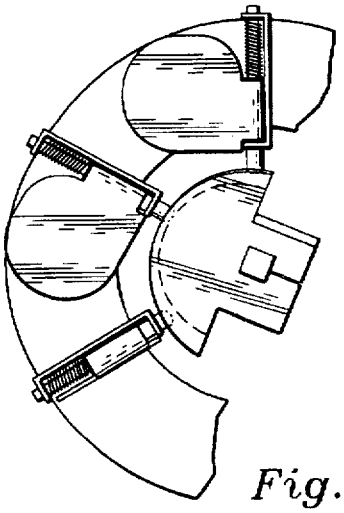
FIG. 10B is a top plan view of that which is shown in FIG. 10A.
Figure 10C:
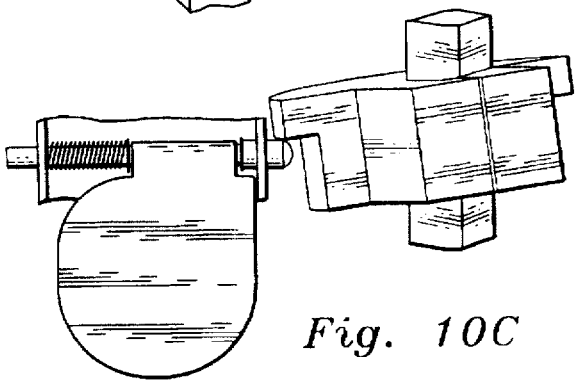
FIG. 10C is a side elevational view of that which is shown in FIG. 10A.
Figure 11:
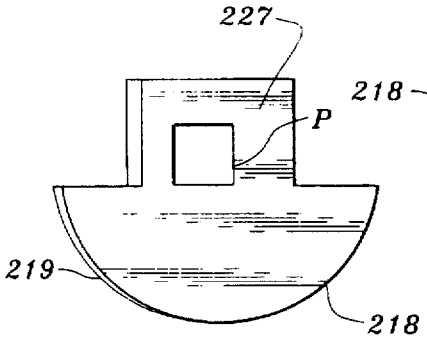
FIG. 11 is a top elevational view of the cam.
Figure 12:
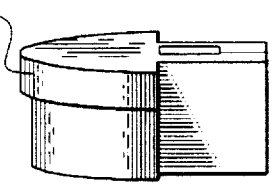
FIG. 12 is a right side elevational view of the cam, but without a chamfer.
Figure 13:
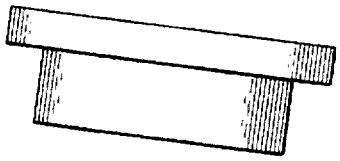
FIG. 13 is a front elevational view of the cam.
Figure 14:
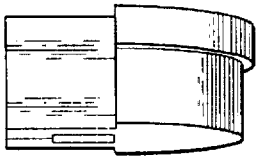
FIG. 14 is a left side elevational view of the cam.
Figure 15:
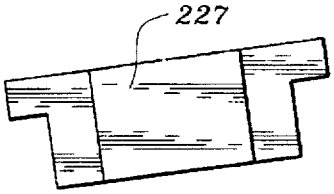
FIG. 15 is a back side elevational view of the cam.
Figure 16:
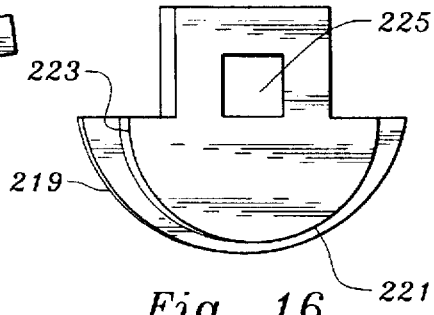
FIG. 16 is a bottom elevational view of the cam.

The trigger mechanism 210 includes a cam 212 (FIGS. 8A–8C) which is operatively coupled to the shaft 176 of the rod 174 at a location interposed between the bottom plate 112 and the top plate 120 of the platform assembly 110. Referring to FIGS. 8 through 10, the cam 212 includes a top portion 214, a bottom portion 216, an arcuate lip 218 and a lobe 220. The cam 212 has an shaft angulation 222 of $\theta$ (theta) with respect to a horizontal plane. Preferably $\theta=6°$ but can range from 0.1° to 50°. This angulation 222 facilitates the cam 212 climbing the helical path of FIG. 17 in response to the latching means being actuated. Each actuation of the latching means results in an apex 221 (FIG. 9C) of the lobe 220 to contact and force the cap 240 against the biasing of the spring 236 along arrow "C" thereby releasing the notch 149 of the platform 142 from the platform contact edge 140 thereby resulting in the platform dropping along arrow "D" from a substantially horizontal plane (a first position) to a substantially vertical downward (second) position such that the article atop the platform is dispensed. Simultaneously, the arcuate lip 218 rides and is supported atop at least one sequentially placed cap 240 thereby allowing the cam to continue its helical path each time the latching mechanism is actuated. Referring to FIGS. 11–16, it is preferred that the lip 218 have a constant radius of curvature R, measured from central point P. Note a leading edge 219 of lip 218 may be chamfered to facilitate climbing on the caps 240 without jamming. FIG. 16 shows the cam 220 has a lobe of greatest duration 221 near a central portion of the cam surface. Note that a leading edge 223 of the active cam surface 220 has a chamfer to ease its transition in contacting the series of caps 240 found on the spiral path. In effect, the caps 240 form a discontinuous "spiral threading" upon which lip 218 "floats" and causes cam 220 to advance vertically up shaft 176. As the cam 220 climbs, the lobe 221 discharges one article at a time. The cam 220 has a square hole 225, complemental to the cam shaft 174. The rear 227 of the cam is a square mass surrounding the hole 225 for support.

In use an operation, at the outset each platform 142 is biased by the spring 234 in a substantially horizontal position and the cam is preferably located at a bottom of the platform assembly 110 proximate the bottom plate 112. Referring to FIG. 8-B the arcuate lip 218 rides atop of at least one cap 240 but does not engage the cap 240 with its lobe 220 located directly below the arcuate lip 218. This allows the cam to rest on the cap 240 without actuating the platform to move from a substantially horizontal position to a substantially vertically downward position. Each article to be vended sits individually and horizontally on a platform 142. Once an appropriate coin is inserted into the coin slot 62 the handle 64 of the coin mechanism 60 is capable of being enabled. Referring to FIG. 5, when the handle is enabled it is allowed to rotate about arrow "A1" which in turn causes the shaft 68 of the latching mechanism to rotate. This rotation causes the crank 70 attached at the end of the shaft 68 to contact at least one radially extending spoke 198 of the spoked wheel 192 and rotate the rod 174 about arrow "B1". The cam in turn rotates along the helical path 260. As noted, the lip 218 of the cam rides atop the cap 240. As the shaft 174 is rotated, the duration of the lobe comes to an apex 221 and forces the cap 240 against the biasing of the spring 234 thereby releasing the platform 242 from a substantially horizontal position and allowing the platform to drop to a substantially vertically downward position. Simultaneously, the lip of the cam rides atop at least one subsequent pin 240 located in the helical path 260. Upon each reactuation of the latching mechanism 66 the cam 212 will traverse the helical path and release each subsequent platform 142 in the above delineated manner until the cam has completely traversed the helical path 260 which at this time would result in the vending of all the articles individually supported on the platforms.

Note that the platforms 142 immediately adjacent the bottom plate 112 (FIG. 3) may be smaller than others (FIG. 2) in order to provide the necessary clearance between the platforms 142 and the bottom plate 112. In addition, the bottom plate 112 is sized small enough such that it does not impede the flow of articles from the platforms to the dispensing hole opening.

Figure 17:
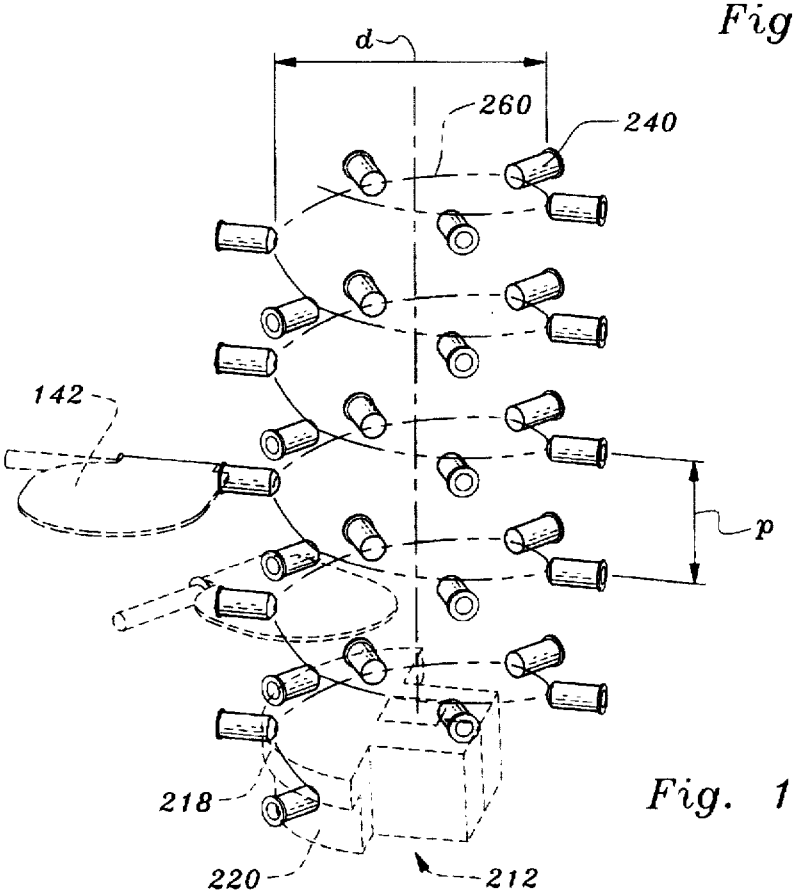
FIG. 17 is an elevational view of the caps disposed about a spiral path.

Referring to FIGS. 8C and 17, the following formula shows one relation between the pitch of threads of the helix 260 and the angle θ:

θ=Arctangent (0.5*p/d)

wherein d=diameter of one revolution of the helix p=pitch of the helix

θ=angle to be determined (in radions)

To convert radians to degrees, simply multiply by 180/PI

For instance the angle may be

Arctan ((0.5*0.5)/1.75)*180/PI≈8.13 degrees.

Moreover, having thus described the invention, it should be apparent that numerous structural modifications and adaptations may be resorted to without departing from the scope and fair meaning of the instant invention as set forth hereinabove and as described hereinbelow by the claims.

We claim:

1. In a vending machine:

a platform upon which an article to be vended is adapted to be placed;

a means operatively coupled to said platform to allow said platform to assume one of two positions:

a first said position where said platform is in a substantially horizontal plane and capable of carrying the article to be vended on an upper surface thereof;

a second said position where said platform is collapsed to a substantially vertically downward position such that the article will have been dispensed;

wherein said means to allow said platform to assume said second position includes a shaft, a cam disposed on said shaft and including means to travel along said shaft, said cam having a lobe with at least one apex located thereon and dimensioned to contact said means coupled to said platform and to rotate said platform from said first position to said second position.

2. The machine of claim 1 further including a housing and a base received within said housing, said housing having at least one dispensing hole opening and said base operatively coupled to and supporting said means coupled to said platform which allow said platform to assume one of two said positions.

3. The machine of claim 2 further including linkage means operatively coupled between a latch mechanism operatively coupled to said housing and said means coupled to said platform which allow said platform to assume one of two said positions.

4. The machine of claim 3 wherein said linkage means includes at least one said cam which, upon actuation of said latch mechanism, coacts with said means coupled to said platform which allow said platform to assume one of two said positions to collapse said platform from said first position to said second position wherein said platform is in the substantially vertical downward position such that the article will have been dispensed.

5. The machine of claim 4 wherein said means coupled to said platform which allow said platform to assume one of two said positions includes an axle assembly, said axle assembly including means to bias said platform in said first position.

6. The machine of claim 5 wherein said cam includes a top portion, a bottom portion, an arcuate lip and a lobe sequentially disposed between said top portion and said bottom portion of said cam, said lobe having at least one apex.

7. In a vending machine:

a platform upon which an article to be vended is adapted to be placed;

said platform operatively coupled to means which allow said platform to assume one of two positions:

a first said position where said platform is in a substantially horizontal plane and capable of carrying the article to be vended on an upper surface thereof;

a second said position where said platform is collapsed to a substantially vertically downward position such that the article will have been dispensed;

a housing and a base received within said housing, said housing having at least one dispensing hole opening and said base operatively coupled to and supporting said means which allow said platform to assume one of two said positions;

linkage means operatively coupled between a latch mechanism operatively coupled to said housing and said means which allow said platform to assume one of two said positions;

wherein said linkage means includes at least one cam which, upon actuation of said latch mechanism, coacts with said means which allow said platform to assume one of two said positions to collapse said platform from said first position to said second position wherein said platform is in the substantially vertical downward position such that the article will have been dispensed;

wherein said means which allow said platform to assume one of two positions includes an axle assembly, said axle assembly including means to bias said platform in said first position;

wherein said cam includes a top portion, a bottom portion, an arcuate lip and a lobe sequentially disposed between said top portion and said bottom portion of said cam, said lobe having at least one apex; and wherein said arcuate lip of said cam rides and is supported atop of said axle assembly and at least one said apex of said lobe coacts with said axle assembly to collapse said platform from said first position to said second position upon actuation of said latch mechanism.

* * * * *